US005097634A

United States Patent [19]

Hulme

[11] Patent Number: 5,097,634

[45] Date of Patent: Mar. 24, 1992

[54] TOOL GRINDER APPARATUS AND METHOD

[76] Inventor: Jack R. Hulme, 3609 Country Club Rd., Duncan, Okla. 73533

[21] Appl. No.: 447,661

[22] Filed: Dec. 8, 1989

[51] Int. Cl.[5] ..... B24B 49/00

[52] U.S. Cl. ..... 51/165.84; 51/95 LH; 51/288; 51/219 PC

[58] Field of Search ..... 51/95 LH, 219 PC, 94 CS, 51/48 HE, 288, 165.74, 165.75, 165.84, 241 G, 219 R,

[56] References Cited

U.S. PATENT DOCUMENTS

| | | | |
|---|---|---|---|
| 2,052,567 | 9/1936 | Haines | 51/95 LH |
| 2,217,545 | 10/1940 | Guenther | 51/219 PC |
| 2,322,510 | 10/1943 | Franzen | 51/95 LH X |
| 2,583,159 | 1/1952 | Swanson | 51/219 R |
| 2,751,718 | 6/1956 | Falkman | 51/219 R |

FOREIGN PATENT DOCUMENTS

| | | | |
|---|---|---|---|
| 365574 | 12/1922 | Fed. Rep. of Germany | 51/219 PC |

OTHER PUBLICATIONS

K. O. Lee "Compact Tool and Cutter Grinders"; 5/86, U.S.; pp. 1–4; Author unknown.

H. D. T. "Cuttermaster"; date unknown, U.S.; pp. 1–4; Author unknown.

"Darex Precision End Mill Sharpeners"; date unknown; U.S.; p. 1–8; Author unknown.

*Primary Examiner*—M. Rachuba

*Attorney, Agent, or Firm*—John R. Kirk, Jr.; Mark A. Oathout

[57] ABSTRACT

The present invention relates to a apparatus and method for sharpening rotary tools which includes a base for supporting a housing and a slidable table. The housing includes a motor which drives a grinding wheel located at the end of the drive shaft. A sleeve is pivotally mounted on one end of the slidable table. A toolholder which holds the tool to be sharpened is placed and is slidable within the sleeve. A spiraled cam is attached to the toolholder. A guidepin, supported by the sleeve, rides within the spiraled groove of the cam to rotate the toolholder such that the tool will be sharpened along a spiraling blade. A pointer is supported by the sleeve for marking each successive point at which the tool will strike the grinding wheel as the toolholder is advanced within the sleeve toward the grinding wheel. The invention may also include a second sleeve mounted on the slidable table such that the central axis of the second sleeve is approximately at a right angle with respect to the central axis of the first sleeve. The second sleeve allows for the toolholder and tool to be placed in position for the sharpening of the end of the tool.

17 Claims, 6 Drawing Sheets

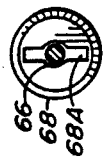
FIG. 8
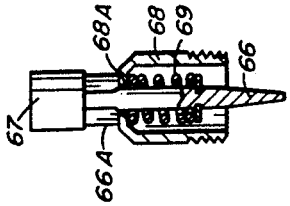
FIG. 9
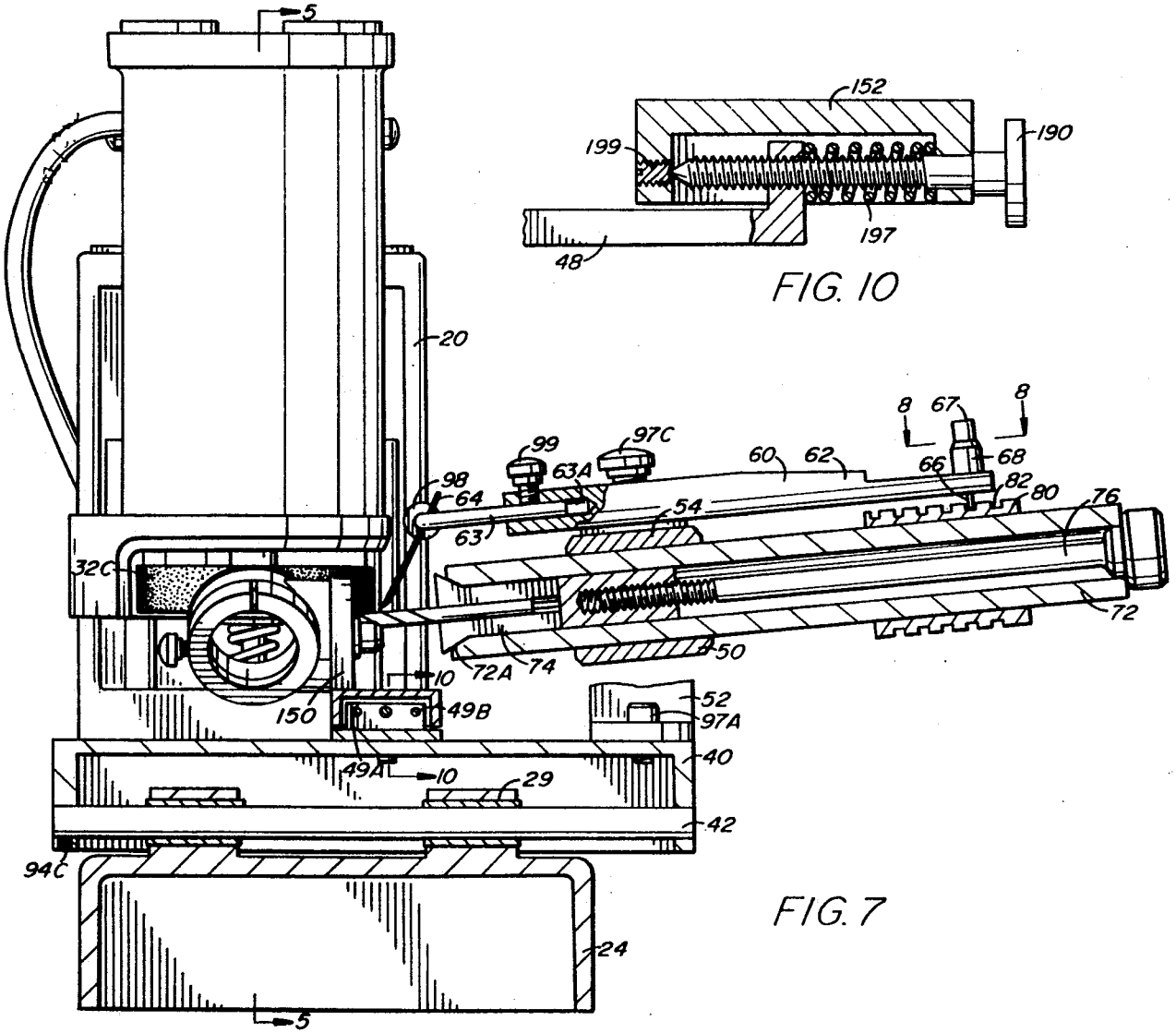
FIG. 10
FIG. 7

TOOL GRINDER APPARATUS AND METHOD

FIELD OF THE INVENTION

The present invention generally relates to tool grinders for sharpening rotary cutters and, more particularly, is concerned with apparatus and method for sharpening rotary cutters both along the edges and at the tip including a proper heel angle cut for the edges of cutters used in rotating machines.

DESCRIPTION OF THE PRIOR ART

All metal working shops have a periodic need for cutters or tools to be sharpened. This is due to the fact that the life of a cutter is short and a typical cutter is dull after cutting 20 to 30 inches of steel. Most shops send their cutters to a specialist to be sharpened. This is expensive and results in down time. Although there are several sharpening grinders on the market, few shops have the ability to sharpen their own cutters.

Tool grinders are machines utilized for the sharpening of cutters. Other do-it-yourself sharpening grinders which are on the market have several deficiencies. For one, these other grinders will not sharpen cutters smaller than ¼ inch in diameter. These grinders also fail to sharpen both right and left hand spirals in right hand cut and both right and left hand spirals in left hand cut. Additionally, these grinders fail to address the problem of grinding proper primary and secondary heel angles for the edge(s) of the cutter.

The more common method of sharpening spiral end cutters is to have a sliding bar which holds the tool to be sharpened and allows the flute or groove of the cutter to ride on a pin. This method has several disadvantages. First, this method requires a sense of touch by the operator to maintain contact between the work piece and the guide pin. Secondly, very small cutters cannot be ground because the guide pin will not fit within the groove in the cutter spirals. Third, this method also requires that the grinding wheel turn in a direction so as to push the cutter toward the pin. If the wheel is reversed, the work piece will be lifted from the pin resulting in damage to the cutter. Another problem is that the full length of the cutter cannot be sharpened since the pin within the groove of the cutter's spiral will reach the end of the groove before the full length of the cutter will be sharpened. Also, more operator time is needed to insure that the edge is riding on the grinding wheel properly. Another problem is that the turning of the grinding wheel toward the guidepin causes a feather or wire edge to be produced. A wire edge is rougher and therefore less desireable than an edge produced by a grinding wheel rotated in the opposite direction. Lastly, these other grinders do not provide effective apparatus and method for sharpening the end of the cutter.

Consequently, a need exists for improvement in the apparatus and methods of sharpening cutters which will result in a tool grinder which is versatile, easy to use and located on-site.

BRIEF DESCRIPTION OF THE DRAWINGS

FIG. 7 is a front elevational view showing a partial cross-section of the first station and the toolholder and showing a cross-section of the horizontal portion of the base, the table, the track and the slide of the invention.

FIG. 8 is a cross-sectional view of the guidepin taken along cross-sectional 8—8 of FIG. 7.

FIG. 9 is a view partly in cross-section of the guidepin shown in the pulled-up position.

FIG. 10 is a partial cross-sectional view along line 10—10 of FIG. 7 showing the track and slide of the invention.

FIG. 11 is an enlarged cross-sectional view of the second station's positioning mechanism shown in FIG. 5.

FIG. 12 is a cross-sectional view along line 12—12 of FIG. 5 showing the collar without the toolholder in place.

SUMMARY OF THE INVENTION

Figure 1:
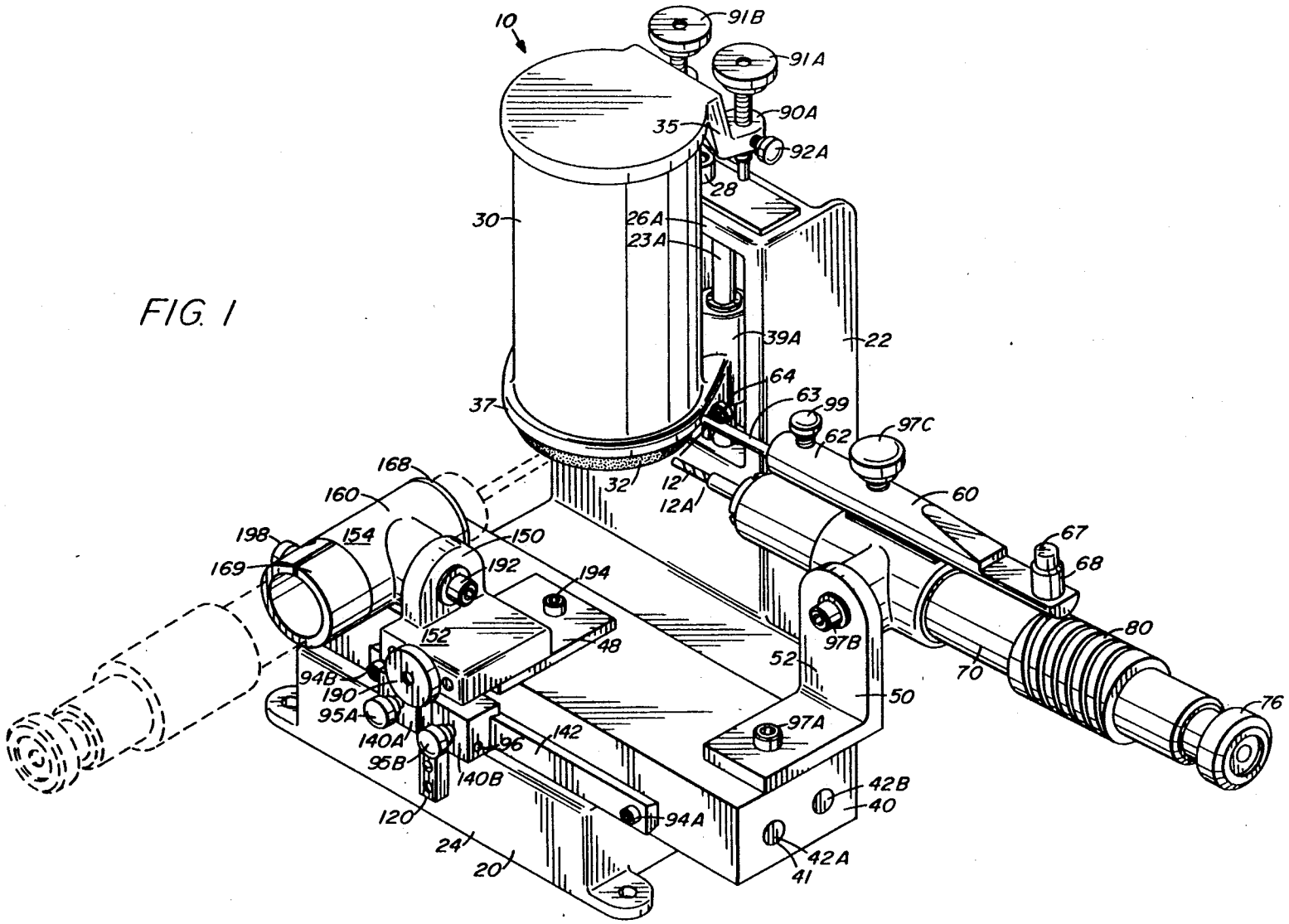
FIG. 1 is a top-front-right perspective view of the cutter sharpening apparatus disclosed herein showing the toolholder and cutter mounted at the first station of the invention.

The present invention provides rotary tool grinding apparatus for sharpening cutters, drills, saws and other machine tools designed to satisfy the aforementioned needs. Tool grinding is carried out on compact, easy to use apparatus such that high quality consistent tool grinding can be done at the workshop site. A ¼ inch end mill can be sharpened to cut like a new cutter in less than a minute. The apparatus accepts a typical collet which is used to hold the cutter in a machine tool, such as in a "BRIDGEPORT" type machine. R8 collets are normally but not necessarily utilized when a cutter in use requires sharpening. The operator can shut down the machine tool, remove the collet which holds the cutter and mount the collet on the grinding apparatus of the invention. No separate chuck or collet is required.

The spiraling blades of the cutter being sharpened are guided along the grinding wheel by a guidepin which rides in a spiraled cam rather than by a guidepin which slides in the flutes of the cutter spirals. Thus, the sharpening process is not limited by the ability of the guidepin to fit within the spiraling grooves of the cutter. This arrangement coupled with precision alignment capabilities allows for the sharpening of cutters with diameters less than 1/16 of an inch. The use of a guidepin in a cam also eliminates the need for the operator to maintain proper touch between the guidepin and the grooves of the cutter. Another advantage is that the sharpening takes place along the whole length or substantially the entire edge of the cutter since the length of the sharpening cut is not dependent upon a distance that a pin can ride within the flute of the cutter.

The cutters can be sharpened in both right and left hand spirals in both right and left hand cut since the motor will drive the grinding head in both clockwise and counter clockwise directions and since the apparatus, through reversing the spiral of the cams, can turn the cutters in both clockwise and counter clockwise directions as the cutter is directed toward and across the grinding head.

The present invention also includes a separate station designed for the sharpening of cutter ends. Prior do-it-yourself tool grinders have not provided apparatus for effective sharpening of cutter ends or faces.

The operator is also able to strike the desired primary cut and secondary relief cut along the ridges of the cutter since the system allows for adjustment of the point at which the grinding wheel will strike the diameter of the cutter and for indexing or orientation of the cutter such that the grinding wheel will strike a desired spiraling line along the blades of the cutter. The cutter may also be moved to a second work station on the tool grinding apparatus for grinding of the desired primary cut and, if desired, the secondary relief cut on the end of the cutter.

Accordingly, the present invention relates to apparatus and method for sharpening rotary tools. The apparatus includes a base for supporting a housing and a horizontally slidable table. The housing includes an electric motor which drives a grinding wheel located at the end of a drive shaft.

A sleeve is pivotally mounted on one end of the slidable table. A toolholder which holds the cutter to be sharpened is placed and is slidable within the sleeve. A spiraled cam is attached to the toolholder. A guidepin, supported by the sleeve, rides within the spiraled groove of the cam to rotate the toolholder such that the cutter will be sharpened along a spiraling blade. A pointer used to aid in the orientation of the cutter to be sharpened is supported by the sleeve for marking each successive point at which the cutter will strike the grinding wheel as the toolholder is advanced within the sleeve toward the grinding wheel.

Another embodiment of the invention includes mounting a second sleeve on the slidable table in a second position such that the central axis of the second sleeve is approximately at a right angle with respect to the central axis of the first sleeve. The second sleeve allows for the toolholder and cutter to be placed in position for the sharpening of the tip of the cutter. The second sleeve may be replaced by a bracket to be utilized for the sharpening of circular or slitting saw cutters to form yet a third embodiment of the invention.

DETAILED DESCRIPTION OF THE PREFERRED EMBODIMENT

Figure 2:
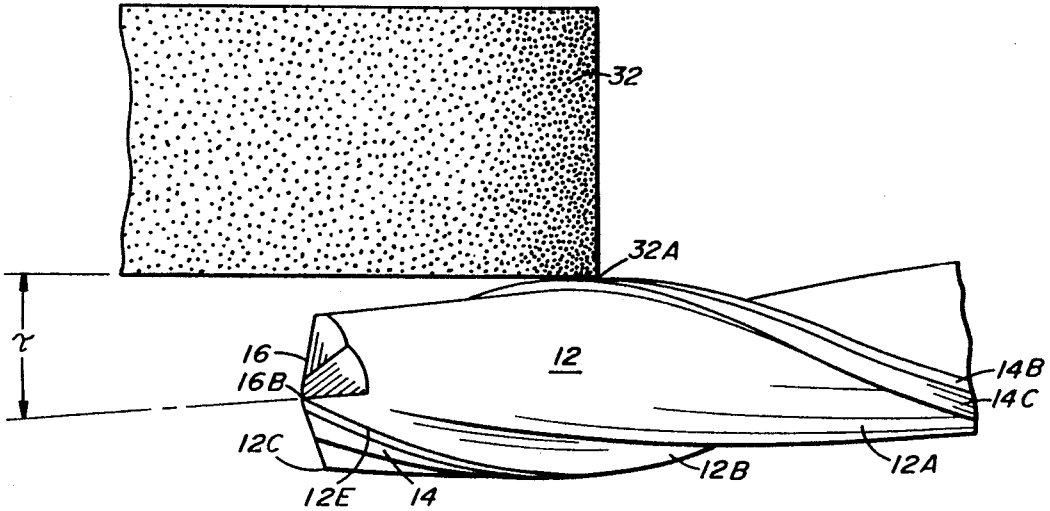
FIG. 2 is a blow-up view of a cutter with a blade being sharpened by the grinding wheel.
Figure 3:
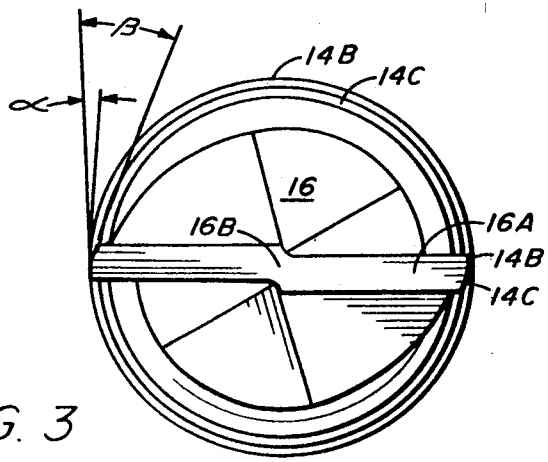
FIG. 3 is an end view of the cutter shown in FIG. 2.

The invention disclosed herein relates to apparatus and method for sharpening rotary tools, especially cutters. Referring to FIG. 1, a typical cutter 12 is shown mounted on cutter sharpening apparatus 10. Cutters generally have one, two, three, four or six flutes or grooves 12A. Referring to FIG. 2 and FIG. 3 these flutes 12A typically have a spiraling configuration. The spaces between the spiraling flutes 12A leave spiraling ridges 12B between or next to the spiraling flutes 12A. Some cutters 12 are also tapered such that the diameter of the cutter 12 increases as you progress from the cutting end 12C to the trailing end 12D (FIG. 5) of the cutter 12.

Each tool or cutter 12 to be sharpened has two types of surfaces to be sharpened. The first type of surface to be sharpened is the blade 14. The blade 14 begins at the edge 12E which is defined by the line of intersection between a consecutive flute 12A and ridge 12B of the cutter 12. The other surface to be cut is the end or tip 16 of the cutter 12.

The cutter 12 typically requires two sharpening cuts. These two sharpening cuts form the blade 14 of the cutter. The primary or first sharpening cut defines the leading or cutting portion 14B of the blade 14. This primary sharpening cut depends on the diameter of the cutter 12 and the hardness of the material to be cut. It typically will have a width of approximately 1/32 of an inch starting from the edge 12E. However, the width may vary with the size of the cutter 12. The primary sharpening cut will be at an angle $\alpha$, called the primary heel clearance, which will be approximately between 1 degrees and 5 degrees off the tangent to the diameter of the edge 12E. If the angle $\alpha$ at which this primary sharpening cut is made is too large, then the blade 14 or cutting edge will be fragile and typically will have a much shorter life. If the primary sharpening cut is zero degrees or at a negative angle, then the cutter 12 will rub the workpiece (not shown), creating heat and destruction to the workpiece and the cutter 12 itself. The relief or secondary sharpening cut follows the primary cut to form the trailing portion 14C of the blade. The secondary sharpening cut is not as critical as the primary sharpening cut. The purpose of the secondary sharpening cut is to provide for a chip removal area. A typical secondary sharpening cut would be at an angle $\beta$, called the secondary heel clearance, which is usually about 15 degrees off the tangent to the diameter of the cutting edge and would intersect the primary sharpening cut at a position leaving the leading portion of the blade 14B about 1/32 of an inch wide. However, the width, and angle of the secondary heel clearance may vary, usually according to the size of the cutter 12.

Figure 5:
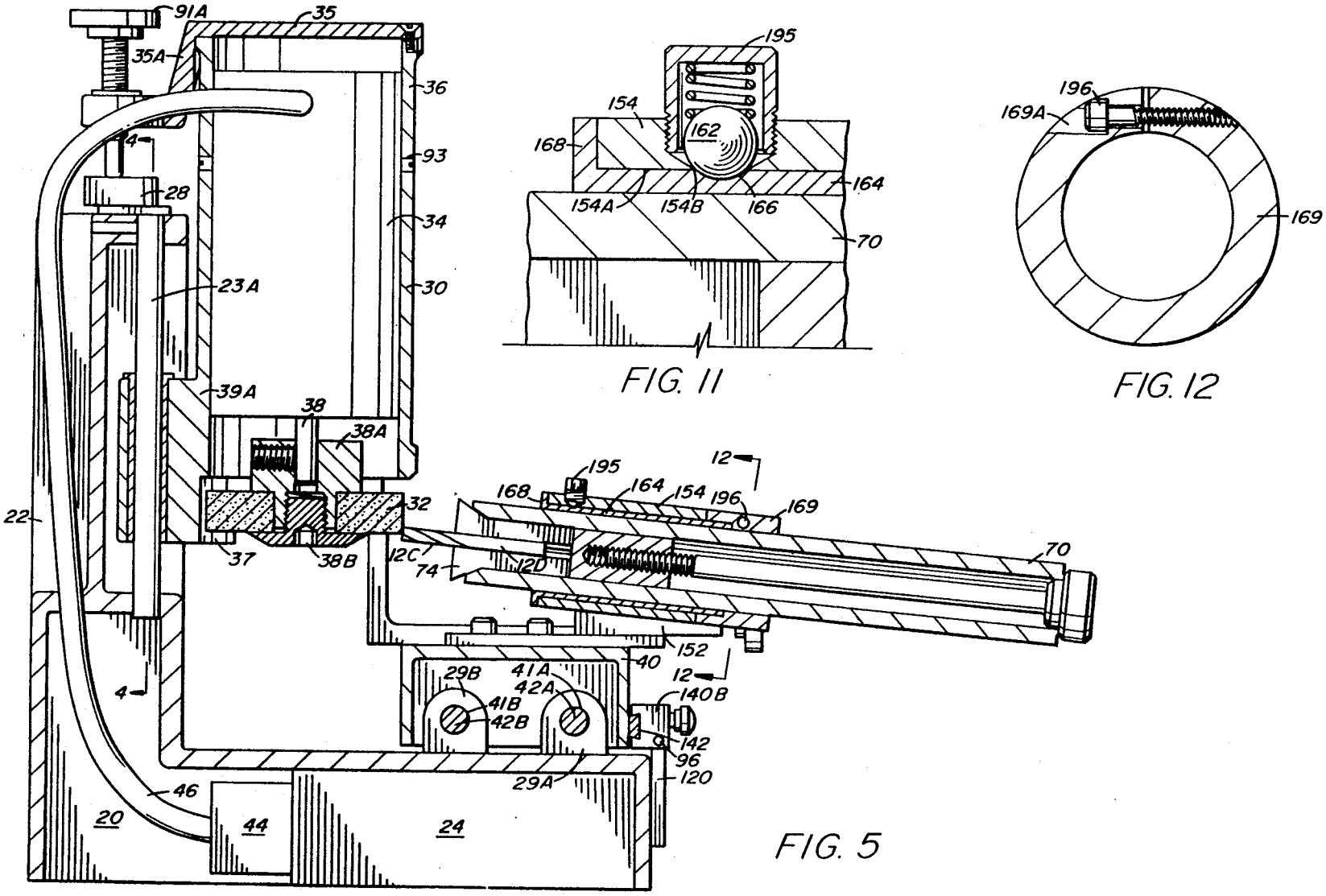
FIG. 5 is a cross-sectional view partially along line 5—5 of FIG. 7 showing the toolholder in place at the second station of the invention and partially along another parallel line through the vertical portion of the base.

The end 16 of the cutter 12 should be sharpened along each cutting edge end 16A. Each cutting edge end 16A should be sharpened so that it depresses or tapers toward the center 16B by grinding the end 16 at an angle as shown in FIG. 5 such that the center 16B will not drag the workpiece. Typically, only a primary sharpening cut will be made although a relief or secondary cut can also be made. Once again, a typical primary sharpening cut will be 1 degrees to 5 degrees off the horizontal and a typical secondary sharpening cut will be 15 degrees off the horizontal and intersect the primary cut at a position leaving it 1/32 of an inch wide.

Referring back to FIG. 1, the cutter sharpening apparatus 10 is shown. The cutter sharpening apparatus 10 generally includes a base 20 which supports the grinding wheel assembly 30, and a slidable table 40. A first sharpening station 50 and a second sharpening station 150 are both mounted on the slidable table 40. Both the first station 50 and the second station 150 are constructed to support a carrier or toolholder 70 which holds the cutter 12 for sharpening by the grinding head or wheel 32. The first station 50 will advance or direct the toolholder 70 toward the grinding head 32 at approximately a 90° angle from the direction that the second station 150 will advance or direct toolholder 70 toward the grinding head 32. Both first station 50 and second station 150 include positioning or indexing mechanisms 60 and 160, respectively, for orienting the cutter 12 to be sharpened.

Figure 4:
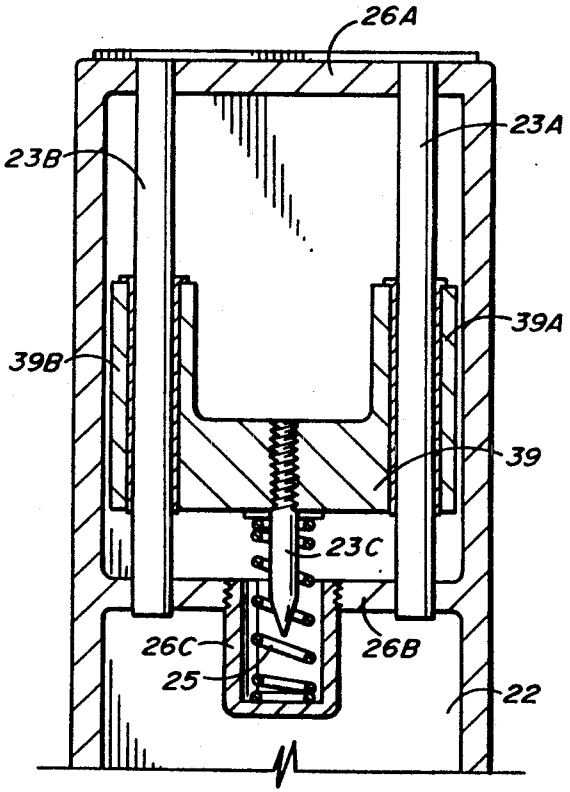
FIG. 4 is a view along line 4—4 of FIG. 5 showing the vertical portion of the base with the casing and cup in cross-section.

The base 20 generally includes a vertical portion 22 and a horizontal portion 24. The vertical portion 22 of the base 20 supports a grinding assembly 30. As shown in FIG. 4, vertical pins 23A and 23B are preferably the same length and are held between an upper shelf 26A and a lower shelf 26B of the vertical portion 22. The vertical pins 23A and 23B fit in precisely bored holes and are preferably bonded with an anaerobic cement such as "LOCTITE 610". These vertical pins 23A and 23B stabilize the grinding assembly 30 when mounted on base 20. They also act as a track or guide upon which grinding assembly 30 can move up and down to accommodate sharpening of various sized cutters 12 or 18 in the first, second and third sharpening stations.

A vertical pin 23C is attached to casing 39 of grinding assembly 30. This attachment is preferably made with an anaerobic cement such as "LOCTITE 610". A vertical spring 25 is seated about vertical pin 23C. The top of spring 25 rests on the casing 39 of grinding assembly 30. Vertical pin 23C fits into a cup 26C which is attached to lower shelf 26B and functions as a guide for spring 25. Spring 25 substantially balances the downward force imparted by the weight of grinding assembly 30 by urging the grinding assembly 30 upwardly. Spring 25 is added as a safety feature designed to protect a cutter 12 which unintentionally crashes into the grinding wheel 32. Thus, any cutter 12 which strikes grinding head exerting a threshold upward force overcoming the net downward force of grinding assembly 30 will cause grinding head 32 to move up within the range allowed by pins 23A and 23B until an equilibrium downward force is obtained against cutter 12. In other words spring 25 prevents a deep cut, gash or burn from being made in cutter 12 if the cutter 12 is advanced unintentionally with a great enough force to displace the grinding assembly 30.

Referring to FIG. 5, grinding assembly 30 generally includes motor 34, motor housing 36, drive shaft 38 and grinding head or abrasive wheel 32 aligned along a vertical axis. This vertical configuration of the grinding assembly 30 is needed to allow a desireable approach of a cutter 12 to the grinding head 32 from all of the stations 50, 150 and 250 disclosed herein. As previously described, the housing 36 is movably mounted on the vertical portion 22 of base 20 along pins 23A and 23B. The housing 36 has a flange 37 at the lower end and casing 39 with bearing casings 39A and 39B each having a hole for accepting pins 23A and 23B for stabilization and vertical movement of grinding assembly 30. A portion of the diameter of flange 37 is removed to expose the grinding head 32 allowing access of the cutting tool 12 to be sharpened. The remaining part of the flange 37 is left intact for safety reasons. Bearing casings 39A and 39B preferably contain linear ball bearings to create precision movement between grinding assembly 30 and base 20.

Figure 6:
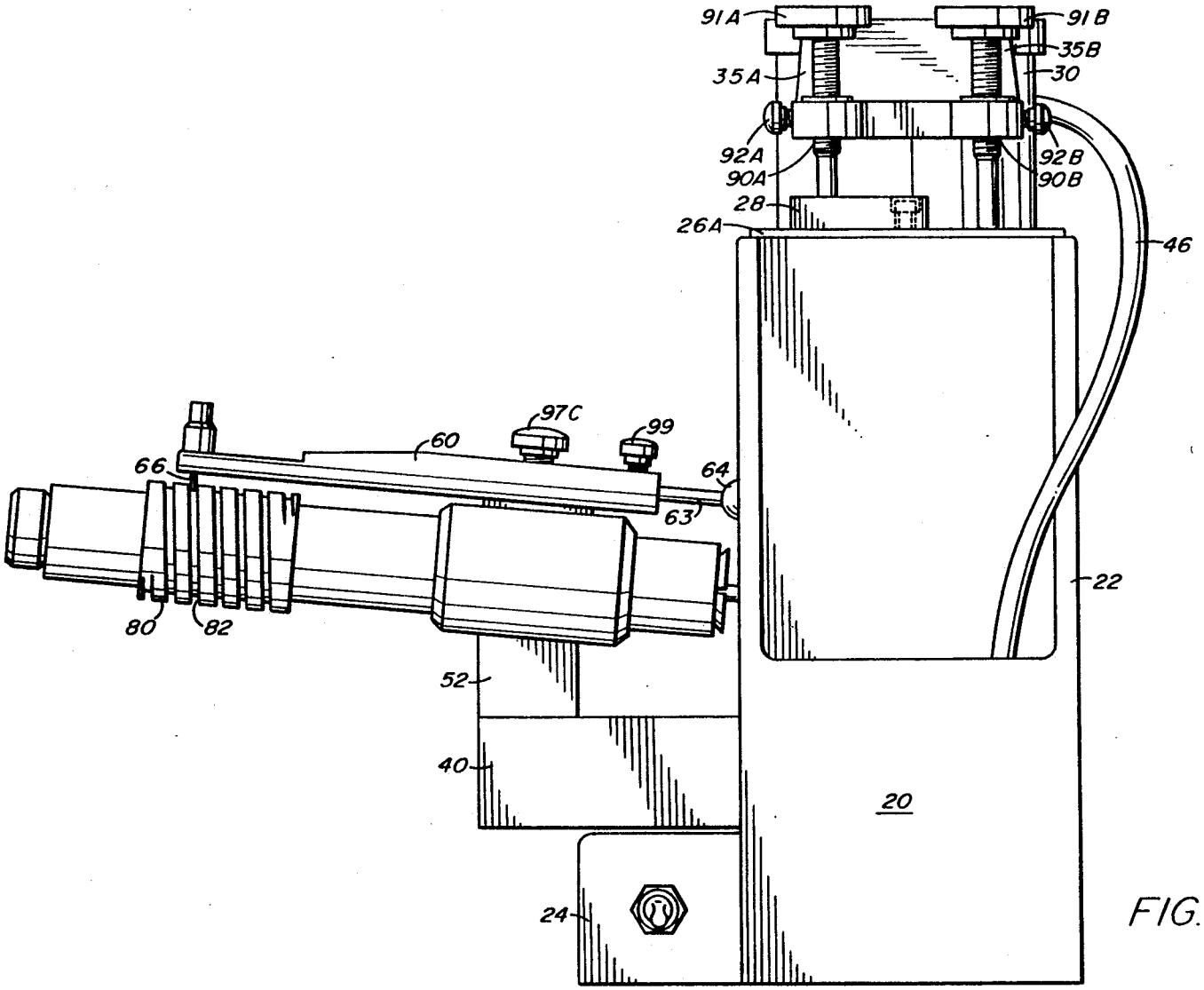
FIG. 6 is an elevational view from the back side of the invention.

The top 35 of housing 36 has a lips 35A and 35B having threaded holes 90A and 90B, respectively. Thumb screws 91A and 91B are threaded through holes 90A and 90B. As shown in FIG. 6, thumb screw 91A has a different length than thumb screw 91B to save time in making level adjustments for cutters 12 with various sized diameters or when moving from sharpening at the first station to the second or third stations and visa versa. A spacing block 28 is threaded or secured by other similar means on top of upper shelf 26A in a manner which allows spacing block 28 to pivot around its securing point. Either thumb screw 91A or thumb screw 91B can be threaded until they come into contact with block 28 which may be pivoted around its point of attachment under either hole 90A or 90B. Once a thumb screw has come into contact with block 28 further rotation of either thumb screw 91A or 91B will cause grinding assembly 30 to be raised or lowered with respect to base 20. In a preferred embodiment, one revolution of either thumb screw 91A or 91B is equivalent to 0.025 inches of vertical movement of grinding assembly 30. Thumb screws 91A and 91B can be locked in place by set screws 92A and 92B, respectively. In this manner, grinding head 32 may be adjusted to strike cutter 12 at a desirable level.

Referring back to FIG. 5, motor 34 may be any type of motor but is preferably a d/c electric motor. The motor 34 is preferably held within housing 36 by set screws 93 but may be held by a clamp, a bulkhead to support the motor 34 or other suitable attachment means. Motor 34 transmits torque to drive shaft 38. Adaptor 38A connects drive shaft 38 to grinding head 32 which is held in place by nut 38B.

The structure of grinding head 32 is well known in the art of sharpening tools. In a preferred embodiment, the grinding wheel will be a CBN diamond abrasive wheel (220 or 240 g.) to produce a good surface finish.

The horizontal portion 24 of base 20 gives support to and enables lateral horizontal movement of a table 40. In a preferred embodiment, four linear bearings 29 are mounted on top of horizontal portion 24. Linear bearings 29A, 29B, 29C (not shown) and 29D (not shown) are preloaded to eliminate side play. This condition is necessary for repeatability and for obtaining a good surface finish on the cutter 12 being ground. The central axis of two groups of two linear bearings 29A, 29B, 29C (not shown) and 29D (not shown) are aligned to accept hard surfaced rods 42A and 42B which slide in linear bearings 29A, 29B, 29C (not shown) and 29D (not shown) allowing for precision movement in one dimension between the table 40 and base 20. It is to be understood that other types of bearings, channels or tracks may be utilized on top of horizontal portion 24 in order to support or provide for movement of table 40. Preferably, a rectifier 44 is mounted within horizontal portion 24 along electrical line 46 which runs through the vertical portion 22 to a direct current motor 34.

Table 40 has holes 41 of sufficient diameter for accepting rods 42A and 42B. Rods 42A and 42B are inserted through holes 41A and 41B in the ends of table 40 through bearings 29A, 29B, 29C (not shown) and 29D (not shown) and through holes 41C and 41D in the other end of table 40 and secured in place by set screws 94C (FIG. 7) screwed up from the bottom and at the ends of table 40. In a preferred embodiment of the invention described all screw adjustments on the grinder are spring loaded to eliminate backlash.

Referring to FIG. 1 and FIG. 5, table 40 may be fixed in position with respect to base 20 through the use of releasable stops 140A and 140B in race 142. Race 142 is held in place against table 40 by set screws 94A and 94B which protrude above the surface of race 142 to keep releasable stops 140 from sliding off the end of race 142. Releasable stops 140 preferably slide on race 142 in a dovetail or channeled fashion. Each releasable stop 140 contains a thumb screw 95. Once the table 40 has been moved to a desirable position under grinding head 32 it can be fixed in position by sliding one releasable stop 140A up against one side of stop bar 120 and tightening thumb screw 95A. Although not always necessary, the other releasable stop 140B may then be slid up and tightened for clamping against the other side of stop bar 120. Fine adjustments can be made by a vernier 96. As shown, a preferred vernier 96 is a set screw, one each, in each releasable stop 140A and 140B. Vernier or set screw 96 can be turned against stop bar 120 followed by tightening of thumb screw 95A and/or 95B. The lateral movement maneuverability of table 40 allows table 40 to be selectively fixed and moved with precision under grinding head 32. It will be understood that the table 40 could be made to allow maneuverability in two or three dimensions to make other adjustments necessary in the sharpening process.

Referring to FIG. 1, table 40 is shown with a first station 50 and a second station 150 mounted thereon. Though not necessarily always mounted on table 40 at the same time, both are utilized for advancing or directing the tool 12 to be cut or sharpened towards the grinding head 32. Both stations 50 and 150 are preferably mounted such that the central axis of both the first station 50 and the second station 150 lie in perpendicular vertical planes which intersect at right angles. The vertical plane through first station 50 will also contain the central axis of grinding head 32. The vertical plane through second station 150 will contain the central axis of grinding head 32, as well, when second station 150 is set dead center (FIG. 7) via releasable stops 140A and/or 140B. These two vertical planes are the same as the cutting planes used to designate FIG. 7 and FIG. 5.

However, it is not required that the vertical planes be perpendicular to each other. What is important is that both first station 50 and second station 150 direct cutter 12 along a line perpendicular to the tangent of the grinding head or in other words along the line which will run through the central axis of grinding head 32 and that first station 50 sharpens the blades or sides 14 of the cutter 12 and second station 150 sharpens the ends 16 of the cutter 12. As shown in FIG. 1, table 40 is preferably rectangular with the first station 50 located along one edge of the table 40 and the second station 150 located along an adjacent edge of table 40 at substantially right angles to the axis of the first station 50.

Referring to FIGS. 1 and 7, the first station 50 generally includes bracket 52, sleeve 54, and positioning mechanism 60. Bracket 52 is used to mount sleeve 54 on table 40. Bracket 52 is threaded to table 40 with bolt 97A and to sleeve 54 with bolt 97B. Sleeve 54 is pivotal around the pivot point of bolt 97B when bolt 97B is loosened. This allows the operator of the tool grinder 10 to adjust the angle of sleeve 54 relative to grinding head 32 such that the tool 12 to be sharpened will contact the corner 32A of grinding head 32 along the blade 14 to be sharpened.

Positioning mechanism 60 is for orienting the blades of the cutter to be sharpened, and generally includes bar 62, pointer 64 and guidepin 66. Bar 62 is connected on top of sleeve 54. This connection may be made by a screw or bolt 97C threaded into the sleeve or by any other common connecting means. A pointer 64 connected via arm 63 is located at the proximal end of the bar 62 and a guidepin 66 is located at the distal end of the bar 62. The pointer 64 is used to index the positioning of cutter 12. More specifically, the pointer 64 indicates the center line of the sharpening cut to be made on the tool 12 to create the sharpened blade 14 of the tool 12.

Pointer 64 is adjustable to accommodate for the various diameters of cutters to be sharpened. Pointer 64 is slidable within a tube clamp 98 in arm 63. Once pointer 64 has been set at a desired position, it may be fixed in place by tube clamp thumb screw 98 or other suitable securing means. Pointer 64 is preferably mounted and slidable along an acute angle with respect to bar 62 to avoid interference with grinding assembly 30. Arm 63 is also adjustable in a horizontal direction with respect to bar 62. Arm 63 will slide within a hole 63A in bar 62 and may be fixed at a desirable position by thumb screw 99 or other suitable securing means.

It is to be understood that the pointer 64 is only one embodiment to be utilized for indexing, orienting or marking the center line of the sharpening cut to be made to set the relative positions between the toolholder 70, the cam 80, and the grinding head 32, relative to each other. The pointer 64 can be replaced with an optical scope with crosshairs or some other magnification device. A magnification of ten to one would be preferable. The optical scope is preferably utilized when cutters are very small and tolerances are very close. The pointer 64 can also be replaced by a laser or some other device for projecting a sharp image on the cutter 12.

The distal end of the bar 62 supports a cam follower or guidepin 66 which also aides in the orienting or positioning of the cutter. As shown in FIGS. 8 and 9, the guidepin 66 is urged downward by a spring 69 such that it protrudes below the surface of bar 62 for sliding into a groove 82 on indexing cam 80 to be described in more detail below. The guidepin 66 may be raised to terminate any contact between the guidepin 66 and the groove 82 in cam 80 by lifting up using knob 67. In a preferred embodiment guidepin 66 will be keyed and seat in a casing 68 which includes a spring 69 by lifting knob 67 and slots 68A for accepting the keyed portion 66A of guidepin 66. Guidepin 66 may then be raised against the force of spring 69 and oriented such that the keyed portion 66A will not fit within the slots 68A. In this position there will be no contact between the guidepin 66 and cam 80.

Referring to FIG. 7, toolholder 70 is for holding the cutter to be sharpened and generally includes a tube 72, a collet 74 and a drawbar 76. Tube 72 is bored and ground to accept collet 74. Preferably, tube 72 will be bored and ground with a taper 72A to increase the area of surface contact between tube 72 and collet 74. Cutter 12 is either fitted in a proper collet or the collet 74 is taken out of the machine when used with the cutter 12 intact. Collet 74 is then drawn into tube 72 by a threaded drawbar or pullbar 76 which is inserted through the other end of the tube 72 and threaded into collet 74. The outer surface of tube 72 is preferably polished and constructed of a diameter sufficient to allow toolholder 70 to slide or be advanced within station 50 or 150 while preventing tilting or teetering within either station 50 or station 150.

Indexing cam 80 with a threaded hole (not shown) can be connected to tube 72 with a set screw (not shown). Any of a number of cams can be utilized with the invention disclosed herein. Each cutter to be sharpened at first station 50 will require a cam with a matching lead to guide the blades to be sharpened across the grinding head 32. The lead is the linear distance advanced per revolution. Each cam includes one or more continuous spiral grooves 82 which determine the lead of the cam 80 and the number of edges 12E to be sharpened. When the cam 80 is attached to toolholder 70 and the toolholder 70 is set at the first station 50, then the guidepin 66, unless retracted, will ride within a groove 82 of cam 80. The cam 80 is used as an index to orient the spiraling blade to be sharpened under the grinding wheel as the toolholder 70 is advanced in sleeve 54. As shown in FIG. 1, a cam with two grooves is utilized for the sharpening of a tool 12 with two edges 12E. This enables the operator to consecutively sharpen each edge of a cutter without changing the position of the cutter 12 relative to the toolholder. The cam may include a different number of grooves to accommodate any number of cutting blades 14 located on the tool. Since the spirals and diameters on cutters vary, the operator must choose the appropriate cam to index a particular cutter. Cams are categorized according to their lead which is defined as the linear inches advanced per revolution and according to the number of grooves they contain to correspond to the flutes of the cutter. An example selection chart appears in Table I:

TABLE I

| | TYPICAL MILL CUTTER LEAD CUTTER DIAMETER | | | |
|---|---|---|---|---|
| LEAD | 2 FLUTES | 4 FLUTES | 3 FLUTES | 6 FLUTES |
| 5/16 | 1/16 IN | | | |
| ½ | 3/32 | | | |
| ¾ | | 5/32 | | |
| 1 | ⅛, 3/16, ¼ | 3/16 | | |
| 1⅛ | | | 3/16 | |
| 1¼ | | | | |
| 1⅜ | ¼ | ¼, 5/16 | | |
| 1½ | | ¼ | 5/16 | |
| 1⅝ | 5/16 | | 5/16 | |
| 1 11/16 | | | | 5/16 |
| 1¾ | 5/16 | 5/16, 11/32 | 5/16 | |
| 1⅞ | 5/16 | 5/16 | 5/16 | |
| 2 | | | ⅜ | |
| 2 1/16 | | ⅜ | | |
| 2⅛ | ⅜ | ⅜ | | |
| 2¼ | | 7/16 | | |
| 2⅜ | 7/16 | | | |
| 2⅝ | | ½ | | |
| 2 11/16 | | | | ½ |
| 2¾ | ½ | ½ | | |
| 2 15/16 | | ½ LONG | | |
| 3 | | 9/16 | | |
| 3⅛ | 9/16 | 9/16 | | |
| 3¼ | | ⅝ | | |
| 3⅜ | | ⅝ LONG | | |
| 3½ | | ⅝ | | |
| 4 | ⅝ | | | |
| 4½ | | ⅞ | | |
| 5 | | ¾ ROUGHING | | |
| 5¼ | | 1 | | |
| 5½ | 1 | | | |

It will be appreciated that for the sharpening of tapered spiral end cutters, the end of the toolholder that holds the cutter 12 may include a profile cam to incrementally raise the grinding head 32 as the cutter is advanced.

Referring to FIG. 7 and FIG. 2, the first station 50 is to be used for the sharpening of the blade or blades 14 of the tool 12. The objective of first station is to sharpen each entire spiraling blade 14 of the tool 12. Hence, first station 50 must direct the entire length or each incremental position of the spiraling blade 14 across the grinding head 32 for sharpening. First station 50 preferably directs the tool 12 towards the grinding head 32 along a line which is perpendicular to a line tangent to the surface 32C at corner 32A of grinding head 32. At first station 50 it is desirable to sharpen the tool 12 by moving it along the corner 32A of grinding head 32 since for each incremental moment in time the operator only desires to be sharpening one point along the spiraling edge of the tool and the sharpening process requires that the tool be inclined downwards via sleeve 54 to obtain clearance for the tool 12 to pass under the grinding head 32 unobstructed by the nut 38B or other securing part which holds the grinding head 32 on the drive shaft 38 while not crashing into table 40. As seen in FIG. 2, the cutter 12 will be sharpened along an angle of declination $\tau$ to strike corner 32A. The angle of declination $\tau$ must be an angle which prevents the cutter 12 from crashing either the nut 38B or the table 40. Any angle of declination between 0° and 90° off the horizontal may be used if cutter 12 is short enough to prevent crashing. A grinding head 32 with a large diameter or a large distance between table 40 and grinding head 32 can also increase the range of an acceptable angle of declination $\tau$. If the cutter 12 is long, the angle $\tau$ must be set so that nut 38B is cleared and so that the entire length of the blade 14 can be sharpened without crashing table 40.

Once toolholder 70 has been mounted in first station 50, first station 50 must first be fixed at a desirable starting location via table 40. Table 40 is set as more fully described below with respect to base 20 via securing of releasable stop or stops 140A and/or 140B up against stop bar 120. This set position will be maintained until the blade or blades 14 of the tool have been completely sharpened through the advancement of toolholder 70 in sleeve 54 as directed or oriented by guidepin 66 within grooves 82 of cam 80. The secondary cut is made by either rotationally changing the position of the collet 74 in tube 72, by removing the guidepin 66 and positioning the cutter 12 by hand, or preferably by loosening the cam setscrew and rotating cam 80 to the next spiral groove. If the secondary cut is also to have a greater heel angle, then the grinding head 32 must be lowered so that it will strike the cutter 12 at a smaller diameter than that used to make the primary cut.

The operator of the grinding apparatus 10 will be able to determine if the proper cam 80 has been mounted on the toolholder 70 by advancing the toolholder 70 at the first station 50 prior to turning on the grinder with the guidepin 66 riding within groove 82 of cam 80 and watching to ensure that pointer 64 marks the center line of a desired sharpening cut to be made on the blade 14 of the tool 12 to be sharpened.

Preferred steps to be taken for grinding a tool to be sharpened at the first station using the apparatus of this invention are described as follows:

1. Release table stops 140 and move sliding table 40 longitudinally to the right in a horizontal plane.
2. Select the proper cam 80 from the cam selector chart for the cutter 12 to be sharpened and mounted on toolholder 70.
3. Remove collet assembly 74 containing cutter 12 from the machine tool and draw the narrow end of the collet 74 into toolholder 70 or place cutter 12 in an accommodating collet 74 and secure in toolholder 70.
4. Slide table 40 to left where pointer 64 nearly touches abrasive wheel 32. Rotate wheel 32 by hand to be sure the wheel 32 does not touch pointer 64. Set right hand table stop 140B to mark this position. (The pointer 64 now marks the intersection of the wheel 32 and cutter 12).
5. Slide table 40 back to the right. Insert the toolholder at first station 50. Position the spiraling blade 14 of cutter 12 under pointer 64 to approximately 1/32 inch behind the cutting edge and at lagging end (back end) 12D of cutter 12. Holding this position, set the guidepin 66 to back end 86 of cam 80. Secure cam 80 onto toolholder 70. Check the relationship created by cam 80 between the spiraling edge 12E of cutter 12 and the pointer 64 by turning toolholder 70 within sleeve 54 until guidepin 66 is in the front end 88 of cam 80.

6. Slide table to grinding position against right hand table stop 140B which was set in step 4. Set left hand table stop 140A to secure table 40 from moving (FIG. 1). Adjust the level of the grinding wheel 32 by adjusting appropriate grinding assembly thumb screw 91A or 91B against spacing block 28 and adjust the angle of declination of cutter 12 via pivotal sleeve 54 such that the cutter 12 will strike corner 32A of grinding wheel 32 creating a primary heel clearance of between 1 degrees to 5 degrees and such that cutter 12 will clear nut 38B. (The relative positions of wheel 32, cutter 12 and cam 80 are now set and ready).
7. Grind blade 14 of cutter 12 making primary cut to remove any dull edges by rotating and advancing toolholder 70 within sleeve 54 while guidepin 66 rides within groove 82.
8. Repeat on other blades 14 of cutter 12 by raising cam guidepin 66 and indexing to next groove 82 in cam 80. (four groove cams are standard, this matches two flute and four flute cutters. Six groove cams are used for three and six flute cutters.)
9. Go back to step five this time positioning pointer 64 to center of trailing portion 14C of blade 14 to make the secondary sharpening cut.
10. Resecure cam 80 to toolholder 70 once the proper relationship between the pointer 42 and blade 14 are set.
11. Lower grinding head 32 by adjusting appropriate grinding assembly thumb screw 91A or 91B against spacing block 28 to a position where the grinding head 32 will strike the cutter 12 leaving the primary cut approximately 1/32 inch wide creating a secondary heel clearance which is approximately 15 degrees.
12. Grind heel clearance or secondary cut such that about 1/32 inch of first grinding is visible by rotating and advancing toolholder 70 within sleeve 54 while guidepin 66 rides within groove 82. Repeat for each trailing portion 14C by indexing cam 80 as in step 8. (The cutter blades 14 are now complete.)
13. Raise cam guidepin 66 and remove toolholder 70 from first workstation 50.

Referring back to FIGS. 1 and 5, the second station 150 generally includes an adjustable slide 152, a sleeve 154 and a positioning mechanism 160. Slide 152 fits over track 48 which is attached to table 40. As shown in FIG. 10, slide 152 is microadjustable with respect to track 48 and hence table 40 through the use of thumb screw 190 which threads into a finely threaded hole in track 48. Compression spring 197 spring loads the threading to prevent backlash in the screw 190 adjustment. A set screw 199 with "LOCTITE" thread and a concave conical end adds stability and increased adjustability to slide 152. As shown in FIG. 7, hard surfaced rods 49A and 49B may also be used with linear bearings to create precision movement between track 48 and slide 152 similar to rods 42A and 42B used for precision movement of table 40 with respect to base 20. Cutter 12 is selectively moved toward or away from the grinding head 32 through the interaction of slide 152 and track 48. The length of slide 152 can vary according to the distance that the second station 150 will need to be advanced. It is to be understood that a rack and pinion assembly may also be used in place of the thumb screw 190 and finely threaded hole to achieve the microadjustability of second station 150 with respect to table 40. The adjustability of slide 152 with respect to track 48 allows second station 150 to be finely adjusted toward or away from grinding head 32 for the sharpening of the end 16 of the tool 12 to be sharpened.

Sleeve 154 is attached to slide 152 by bolt 192. If bolt 192 is not tightened, sleeve 154 Will be able to pivot around pivot point created by bolt 192 with respect to slide 152. This gives the operator of the tool grinder 10 the capability to adjust the angle at which the end 16 of tool 12 will strike the grinding head 32. The operator generally desires to sharpen the end 16 of the cutter 12 such that it will have a depressed cross section. This is so that when the cutter 12 is in use it will contact the work on the outer edge of cutter 12 rather than have the center of cutter 12 drag across and scar the workpiece. As shown in FIG. 5, the depressed cross section is achieved by angling the cutter 12 upwards towards the grinding head 32 and sharpening separately each edge end 16A of the cutter 12 by striking the grinding head only from the center of the cutter out to each individual blade to be sharpened. The depressed cross-section is not seen in FIG. 2 since the two flutted cutter 12 is shown rotated approximately 90° from the rotational position of the cutter 12 as shown in FIG. 5.

The primary cut on the edge end 16A should be about 1 degrees to 5 degrees off the horizontal, where the horizontal is defined by a plane which is perpendicular to the longitudinal axis of the cutter 12. This primary cut is made at about a 1 degree to 5 degree angle by setting the second station 150 via releasable stops 140A and 140B to a position where the cutter 12 will be directed to a point on the grinding head 32 which is about 1 to 5 degrees to the right o dead center (the dead center position is shown in FIG. 7) on the abrasive surface 32C of grinding head 32. This dead center position is defined by the intersection of a line emanating from the longitudinal axis of sleeve 154 through the central axis of the grinding head 32 when the second station 150 is at its closest distance of approach to the grinding head 32 via sliding table 40 with respect to base 20. Second station 150 can also be fixed at this closest distance of approach and the angled cut can be made by swiveling second station 150 relative to table 40 around bolt 194 to position for the primary cut and/or a secondary cut on the end 16 of the cutter 12. The secondary cut on the end 16 can also be done freehand. It is to be understood that table 40 and mounting slide 152 could contain detents and a spring loaded ball to pivot second station 150 to preset positions to obtain desirable primary and secondary cuts on the end 16 of the cutter 12.

As shown in FIG. 5 and FIG. 11, positioning mechanism 160 includes sleeve 154, index ball 162 and pipe 164 with detents 166 for orientation or rotary indexing of the cutter 12. Sleeve 154 has an index ball 162 which is spring loaded preferably within a screw 195 and protrudes through an aperture 154B on the inner surface 154A of sleeve 154. A pipe 164 with a flanged end 168 slides into sleeve 154. Pipe 164 has twelve evenly spaced detents 166 around its outer diameter or circumference. When pipe 164 is within sleeve 154 such that flange 168 abuts one end of sleeve 154, detents 166 will be longitudinally aligned with index ball 162. The inner diameter of pipe 164 accepts toolholder 70. A collar 169 with notch 169A, as seen in FIG. 12, is secured or clamped around pipe 164 by screw 196. Collar 169 includes a thumb screw 198 which is used to hold toolholder 70 in a fixed position relative to collar 169 and pipe 164. When pipe 164, collar 169 and toolholder 70 are all secured together, they may be rotated within sleeve 154 to any of the twelve preset positions created by a detents 166 lining up with index ball 162. These preset positions are used to position or index each blade 14 of the cutter 12 to be sharpened.

Toolholder 70 can also be positioned at the second station 150 within collar 169. Collar 169 rotates and indexes within sleeve 154 to set each cutting edge end 16A for sharpening. The toolholder 70 is held stationary within collar 169 by the tightening of thumb screw 198. Each cutting edge end 16A to be sharpened can then be finely advanced toward the grinding wheel through the use of microadjustable slide 152 on track 48.

Preferred steps to be taken for grinding a tool to be sharpened at the second station using the apparatus of this invention are described as follows:

1. Insert toolholder 70 in second station 150 and set one cutting edge end 16A about 1 degree to 5 degrees to the right of the dead center (the dead center position is shown in FIG. 7) via releasable stops 140A and 140B and/or bolt 194. Set sleeve 54 on a incline via bolt 92 for grinding the depressed cross-section of the end 16.
2. Lower or raise grinding head corner 32A to center 16B of cutter 12 by adjusting appropriate grinding assembly thumb screw 91A or 91B against spacing block 28.
3. Advance cutter 12 about 0.005 inch into abrasive wheel 32 with second workstation's screw controlled slide 152 by turning thumb screw 190 and grind end or face 16. Repeat for other faces by indexing second stations rotary index or positioning mechanism 160 until the cutter 12 is completely sharpened on all ends cutting edge ends 16A.
4. Set cutter 12 ten to fifteen degrees to right of dead center (the dead center position is shown in FIG. 7) via releasable stops 140A and 140B and/or bolt 194 and repeat step 16 to grind secondary cut on each edge end 16A (the secondary cut may also be done freehand).
5. Remove cutter 12 from second station 150.

Figure 13:
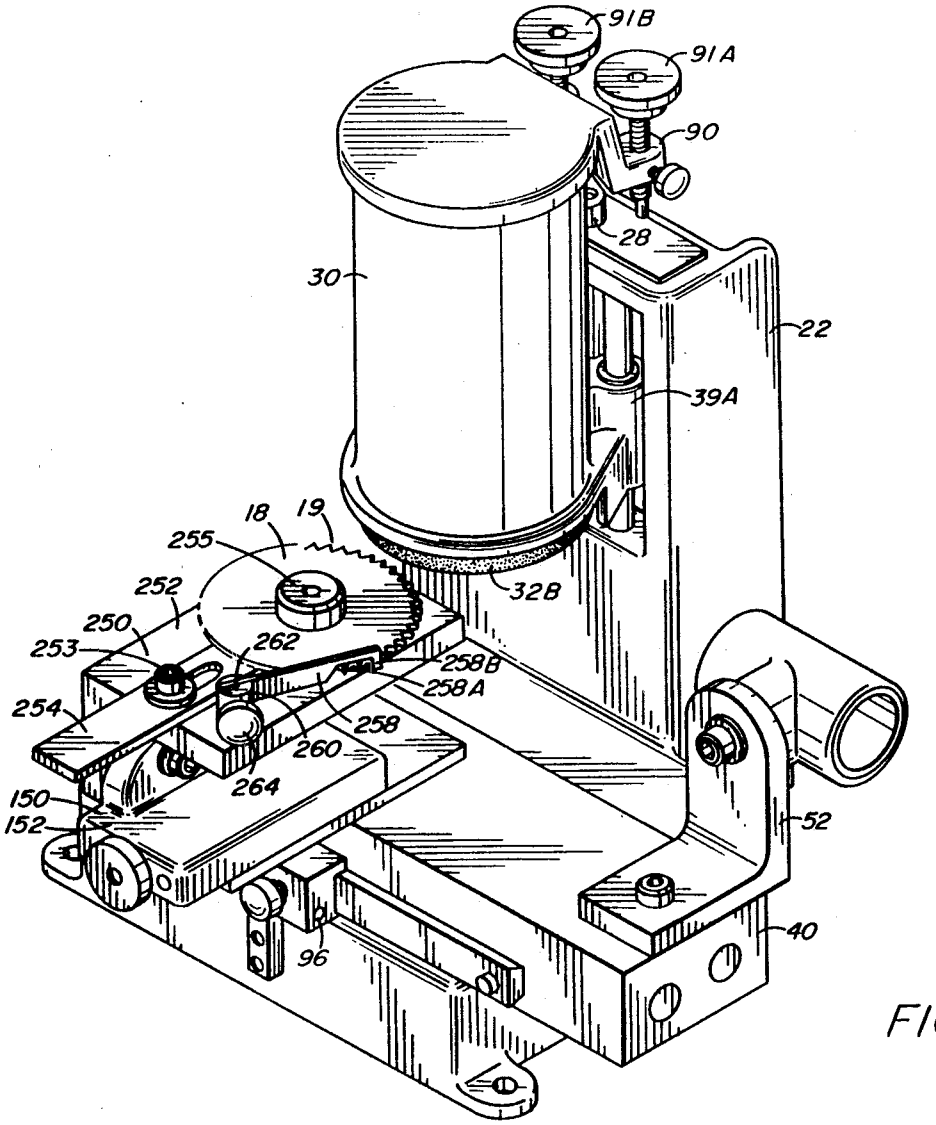
FIG. 13 is a top-front-right perspective view showing the third station of the invention.

Referring now to FIG. 13, third station 250 for sharpening circular saw cutters 18 may be used at the location of second station 150. This station 250 generally includes mounting bracket 252, slotted bar 254 and pawl 258. Mounting bracket 252 is mounted by bolting or other suitable attachment means on slide 152. A slotted bar 254 is bolted on top of the mounting bracket 252 by bolt 253. A knob 255 is attached to one end of the bar 254. A circular saw cutter 18 to be sharpened is held by seating over knob 255. Each tooth 19 of the circular cutter 18 to be sharpened is oriented by a flexible pawl 258. Pawl 258 has a notch 258A and a tip 258B which fits between the teeth 19 of circular saw cutter 18. The pawl 258 is adjustable in a clamp 260 which, as shown, includes a slot 262 and thumb screw 264. Circular saw cutters of differing diameters may be accommodated at station 250 by moving or advancing the distal end of bar 254 towards or away from bolt 253 and by adjusting pawl 258 and clamp 260. Once the circular saw cutter 18 is postioned an individual tooth 19 can be advanced towards the grinding head 32 by advancing screw controlled slide 152.

Preferred steps to be taken for grinding a circular or slitting saw cutter 18 to be sharpened using the apparatus of this invention are described as follows:

1. Attach the circular saw mounting bracket 252 at the second station 150.
2. Set table via releasable stops 140A and 140B at a position where the center of slotted bar 254 is aligned with the center of the grinding head 32.
3. Seat circular saw cutter 18 over knob 255 on slotted bar 254.
4. Fix slotted bar 254 and pawl 258 in positions where the tooth 19 of the circular saw 18 nearest the grinding head 32 protrudes beyond the edge 252A of the mounting bracket 252 and in a position where the tip 258B of pawl 258 will catch between two teeth 19 of the cutter 18.
5. Advance cutter 12 into abrasive wheel 32 with screw controlled slide 152 and grind tooth 19. Repeat step four for other teeth 19 indexed by pawl 258 until all teeth 19 are sharpened.
6. Remove cutter 18 from knob 255.

The preferred embodiment of this invention has been shown and described above. It is to be understood that minor changes in the details in construction and arrangement of the parts may be made without departing from the spirit or scope of the invention as claimed.

I claim:

1. A tool grinder comprising:

a base;

sharpening means supported by said base;

a table slidably mounted on said base;

a means for advancing the tool to be grinded by said sharpening means, said means for advancing being stationarily mounted on said slidable table;

means for holding the tool to be grinded by said sharpening means, said means for holding being slidably mountable in said means for advancing;

a cam mounted on said means for holding, said cam including a groove for indexing the tool to be grinded;

a guidepin which slides in said groove of said cam, said guidepin being supported by said means for advancing the tool;

a horizontally adjustable arm mounted on said means for advancing;

a pointer slidably mounted on said arm at an angle acute to said arm whereby an operator of the tool grinder can check the relationship between the indexing of said groove of said cam and the blades of the tool to be grinded and can mark the center of the sharpening cut to be made on the blade; and a means for marking the centerline of an entire length of the blade of the tool to be grinded, said means for marking the centerline including said arm, said pointer, said cam, said guidepin and said means for holding the tool.

2. The tool grinder according to claim 1, wherein said sharpening means comprises a grinding assembly, said grinding assembly including a motor and a grinding head which is driven by said motor.

3. The tool grinder according to claim 2, wherein said grinding assembly includes at least one vertical pin and a spring seated on said vertical pin wherein said pin rides on said base against the force of said spring for supporting said grinding assembly on said base.

4. The tool grinder according to claim 1, wherein said means for advancing the tool comprises a sleeve pivotally mounted on said slidable table and said holding means comprises a toolholder which is slidably mounted in said sleeve for advancing the tool toward said sharpening means.

5. The tool grinder according to claim 4, wherein said toolholder comprises a polished tube and a collet for holding the tool, said collet being secured within said polished tube.

6. The tool grinder according to claim 1, further including a second means for advancing the tool and a second means for holding the tool whereby the end of the tool may be properly indexed and held for grinding.

7. The tool grinder according to claim 6, wherein said second means for advancing the tool comprises:

a second sleeve pivotally mounted on and microadjustable with respect to said slidable table and said second means for holding the tool comprises a toolholder which is slidably mounted in said second sleeve, said toolholder including a polished tube and collet for holding the tool to be grinded.

8. The tool grinder according to claim 1, further including a second cam mounted on said means for holding whereby said sharpening means is incrementally moved as the tool is advanced toward said sharpening means such that the blade of the tool having a tapered diameter will be grinded.

9. The tool grinder according to claim 1, wherein said cam is reversible such that said cam can be mounted on said means for holding for sharpening both a right and a left hand tool spiral.

10. A tool grinder comprising:

a base including a vertical and a horizontal portion;

a grinding assembly, said grinding assembly including a housing attached to the vertical portion of said base, a motor connected within said housing, a vertically oriented drive shaft driven by said motor and a grinding head connected to and driven by said drive shaft;

a table mounted on said horizontal portion of said base, said table being slidable in one direction on a substantially horizontal plane with respect to said base wherein said table includes at least one releasable stop for setting the position of said table relative to said base;

a first station for sharpening the blades of the tool, said first station including alternatively;

a first pivotal sleeve stationarily mounted on said table whereby said slidable table causes said first sleeve to be selectively moved toward or away from said grinding head;

a horizontally adjustable arm mounted on said first sleeve;

a pointer slidably mounted on said arm at an angle acute to said arm;

a guidepin vertically and supported by said first sleeve;

a means for marking the centerline of an entire length of the blade of the tool to be grinded, said means for marking the centerline including said arm, said pointer, and said guidepin, a second station for sharpening the tip of the tool, said second station including:

a track attached to said base; and a slide mounted on said track, wherein said slide is microadjustable with respect to said track.

11. The tool grinder according to claim 10, further comprising a second sleeve being pivotally mounted on said slide, said second sleeve including orienting means for indexing the end of the tool to be grinded.

12. The tool grinder according to claim 10, further comprising:

a bracket attached to said slide;

a slotted bar attached to said bracket;

a knob for supporting the tool to be sharpened, said knob being attached to said slotted bar;

a clamp attached to said bracket; and a flexible pawl held by said clamp, said pawl to be utilized for indexing the tool to be grinded.

13. The tool grinder according to claim 10, further comprising:

a tube slidably mountable in either of said sleeves;

a collet for holding the tool to be cut, said collet being disposed within said tube; and a cam mounted on said tube, said cam including a groove for receiving said guidepin when said toolholder is mounted at said first station whereby the blade of the tool to be grinded is indexed by said guidepin riding in said groove as the tool is advanced toward the grinding head.

14. The tool grinder according to claim 10, wherein said cam is reversible such that said cam can be mounted on said means for holding for sharpening both a right and a left hand tool spiral.

15. A tool grinder comprising:

a base;

sharpening means supported by said base;

a table slidably mounted on said base;

a means for advancing the tool to be grinded by said sharpening means, said means for advancing being stationarily mounted on said slidable table;

means for holding the tool to be grinded by said sharpening means, said means for holding being slidably mountable in said means for advancing;

a cam mounted on said means for holding, said cam including a groove for indexing the tool to be grinded;

a guidepin which slides in said groove of said cam, said guidepin being supported by said means for advancing the tool;

an adjustable arm mounted on said means for advancing;

a pointer mounted on said arm at an angle acute to said arm; and a means for marking the centerline of an entire length of the blade of the tool to be grinded, said means for marking the centerline including said arm, said pointer, said cam, said guidepin and said means for holding the tool.

16. The tool grinder according to claim 15, further including a second means for advancing the tool wherein said second means for advancing the tool comprises:

a bracket supportable by and microadjustable with respect to said base; and a slotted bar attachable to said bracket whereby said bar may be advanced toward the sharpening means by attaching said bar to said bracket at a different position along said slot.

17. The tool grinder according to claim 15, wherein said cam is reversible such that said cam can be mounted on said means for holding for sharpening both a right and a left hand tool spiral.

* * * * *